US009562542B1

(12) United States Patent
Gehring

(10) Patent No.: US 9,562,542 B1
(45) **Date of Patent: *Feb. 7, 2017**

(54) EFFICIENT DRYING FAN

(71) Applicant: Technologies Holdings Corp., Houston, TX (US)

(72) Inventor: Kenneth C. Gehring, Cottage Grove, WI (US)

(73) Assignee: Technologies Holdings Corp., Houston, TX (US)

( * ) Notice: Subject to any disclaimer, the term of this patent is extended or adjusted under 35 U.S.C. 154(b) by 750 days.

This patent is subject to a terminal disclaimer.

(21) Appl. No.: 14/051,047

(22) Filed: Oct. 10, 2013

Related U.S. Application Data

(63) Continuation of application No. 11/385,460, filed on Mar. 21, 2006, now Pat. No. 8,579,582.

(51) Int. Cl.
*F04D 29/42* (2006.01)
*F04D 29/52* (2006.01)
*F04D 29/60* (2006.01)

(52) U.S. Cl.
CPC ..... *F04D 29/526* (2013.01); *F04D 29/60* (2013.01)

(58) Field of Classification Search
CPC ..... F04D 29/526; F04D 29/60
USPC .... 415/219.1, 218.1, 220, 221; 34/201, 218, 34/230, 232, 233, 618, 620, 622
See application file for complete search history.

(56) References Cited

U.S. PATENT DOCUMENTS 43,530 A * 7/1864 Stillman ..... F26B 5/06 34/237
2,554,602 A * 5/1951 Sutton ..... F04D 29/545 29/511
2,572,120 A * 10/1951 Dixon ..... A47B 37/00 415/121.3
2,582,532 A * 1/1952 Dean ..... F04D 29/526 415/211.2
2,583,374 A * 1/1952 Hoffman ..... F04D 25/14 415/144
2,593,217 A 4/1952 Sutton
2,616,617 A * 11/1952 Hill ..... F04D 29/646 415/121.3
2,896,337 A * 7/1959 Blythe ..... A01K 43/005 34/218
3,286,368 A * 11/1966 Thomas ..... A47L 11/32 15/339
4,145,821 A * 3/1979 Schantz ..... F26B 21/001 34/237
5,747,773 A * 5/1998 Griffin ..... B23K 9/1006 219/130.1

(Continued)

FOREIGN PATENT DOCUMENTS

GB 2414784 A 12/2005
JP 358038319 A 3/1983
JP 406042498 A 2/1994

OTHER PUBLICATIONS

Injectidry Product Line, Injectidry Systems, Inc., website: http://www.injectidry.com/PRODUCTS.PDF (visited Feb. 17, 2004).

(Continued)

*Primary Examiner* — Ninh H Nguyen
*Assistant Examiner* — Aaron R Eastman
(74) *Attorney, Agent, or Firm* — Andrus Intellectual Property Law, LLP

(57) ABSTRACT

A drying fan has a shroud with a shape selected to improve fan efficiency by designated fluid dynamics of air flow through the fan.

3 Claims, 4 Drawing Sheets

(56) References Cited

U.S. PATENT DOCUMENTS

| | | | | |
|---|---|---|---|---|
| 5,772,500 | A | 6/1998 | Harvey et al. | |
| 5,893,216 | A | 4/1999 | Smith et al. | |
| 6,111,748 | A | 8/2000 | Bhatia | |
| 6,615,508 | B1 | 9/2003 | Valle | |
| 6,647,639 | B1 | 11/2003 | Storrer | |
| 7,007,403 | B1 * | 3/2006 | Studebaker | E04B 1/7092 34/90 |
| 7,201,563 | B2 * | 4/2007 | Studebaker | E04B 1/7092 415/209.3 |
| 7,331,759 | B1 | 2/2008 | Tejeda | |
| 2006/0067818 | A1 * | 3/2006 | Studebaker | E04B 1/7092 415/198.1 |
| 2007/0157485 | A1 * | 7/2007 | Andrisin, III | G09F 7/00 34/201 |

OTHER PUBLICATIONS

Dri-Eaz Ace Turbo Dryer—stackable airmover, website: http://www.dri-eaz.com/products/ace.html (visited Jan. 21, 2005).

Dry Air Force Air Movers at Jon-Don, website: http://www.jondon.com/galeforce/default.htm (visited Jan. 21, 2005).

Studebaker Enterprises, Inc. AirPath Dryer, website: http://www.studebakerenterprises.com/default_airpath.html (visited Apr. 24, 2006).

* cited by examiner

EFFICIENT DRYING FAN

CROSS REFERENCE TO RELATED APPLICATION

The present application is a continuation of co-pending U.S. patent application Ser. No. 11/385,460, filed Mar. 21, 2006, which application is incorporated herein by reference.

BACKGROUND AND SUMMARY

The invention relates to drying fans, including for water damage restoration.

In the water damage restoration industry, fans are used for drying a water damaged structure, including carpeting, furniture, framework, etc. If water can be evaporated quickly, damage can be minimized. The fans move air over the water damaged surfaces at high velocity.

The present invention arose during continuing development efforts directed toward drying fans, including higher efficiency enabled by improved fluid dynamics of the air flow through the fan.

DETAILED DESCRIPTION

Figure 1:
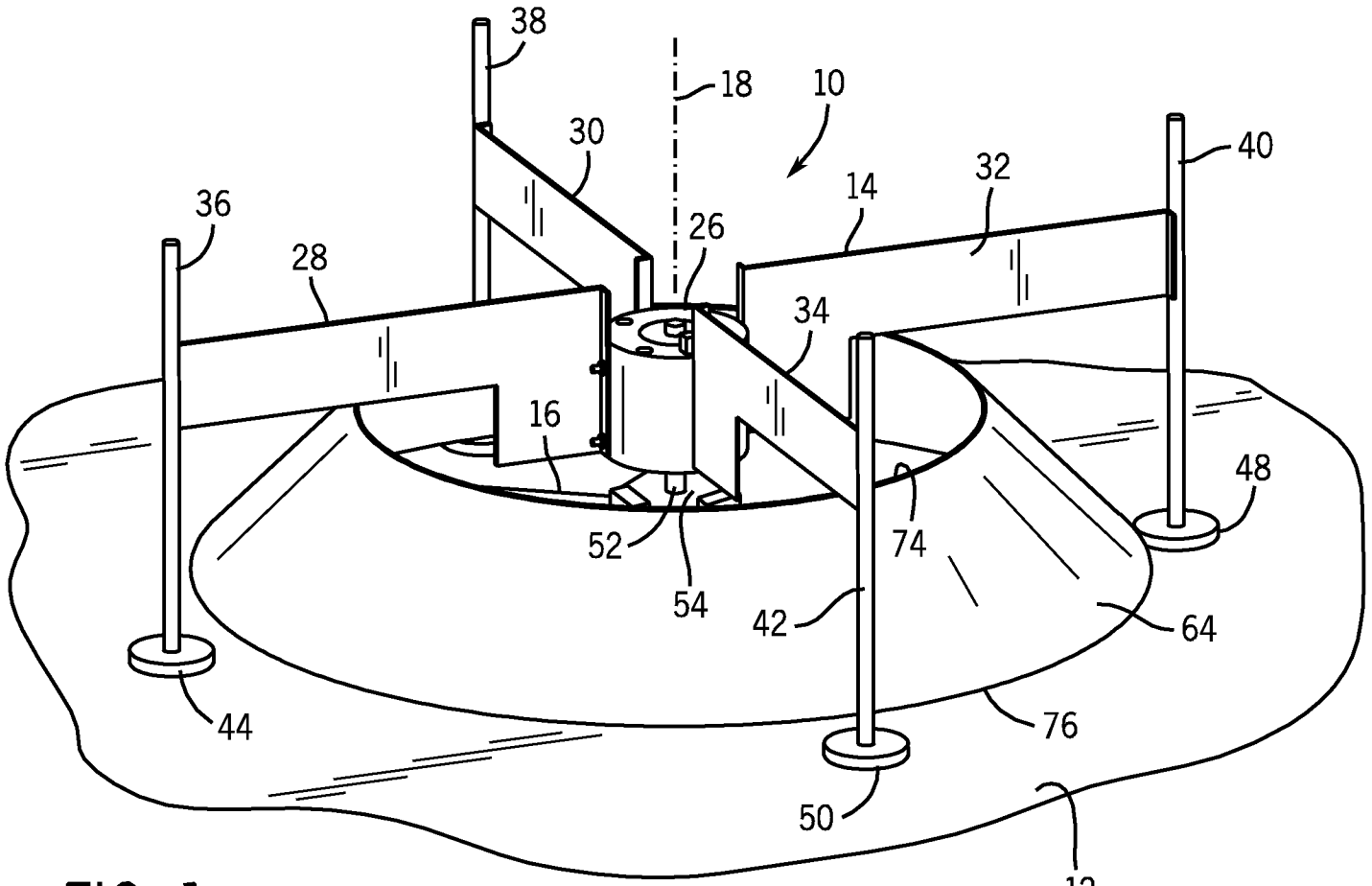
FIG. 1 is a perspective view of a drying fan constructed in accordance with the invention.
Figure 2:
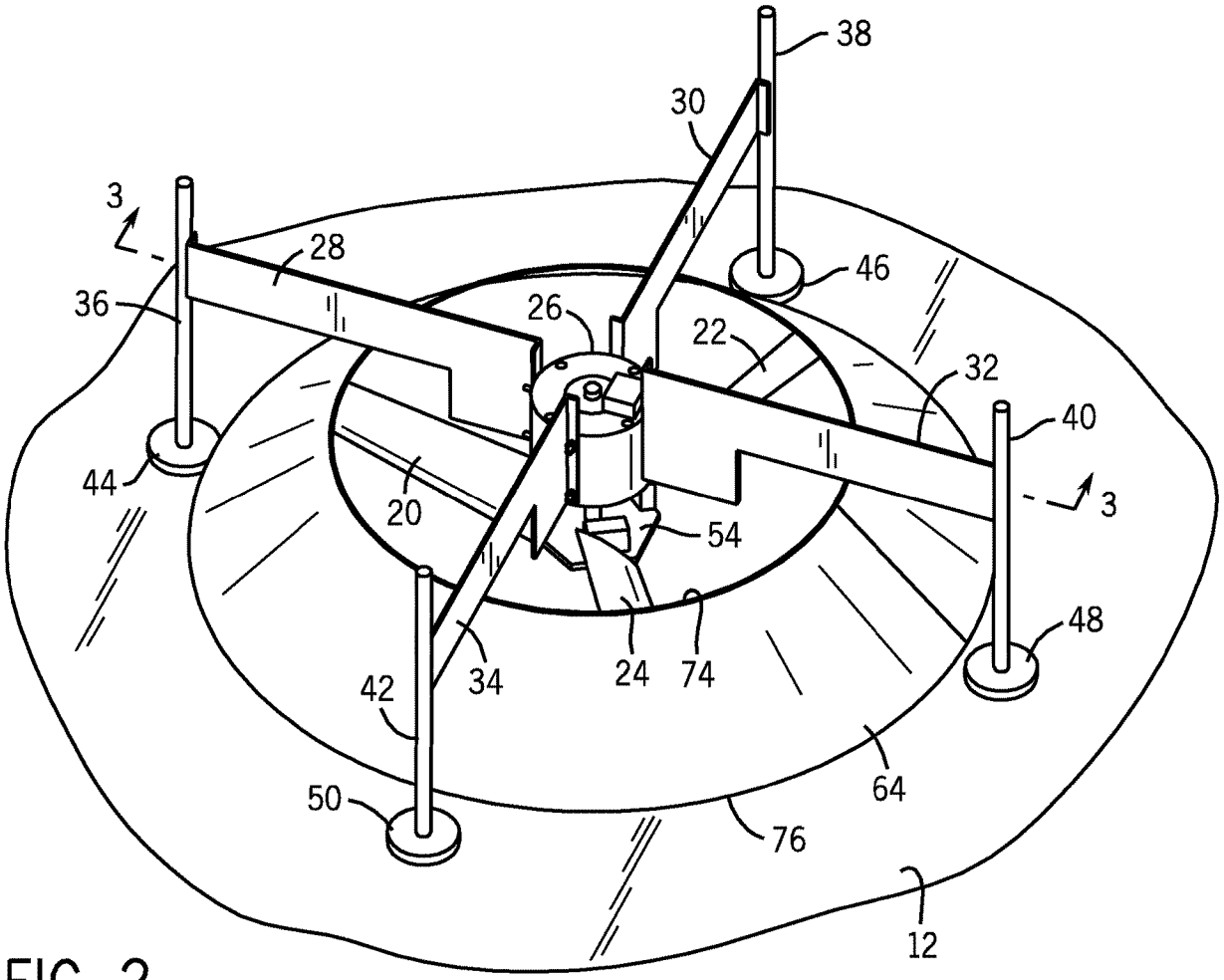
FIG. 2 is another perspective view of the drying fan of FIG. 1.

FIG. 1 shows a drying fan 10 for drying a surface 12, such as a water damaged floor, carpeting, etc. The fan includes a housing 14, a motor driven fan 16 supported on the housing for rotation about an axis 18 and having fan blades 20, 22, 24, FIGS. 2, 3, directing air axially and radially relative to axis 18. The fan blades are driven by motor 26 mounted to and supported by lateral arms 28, 30, 32, 34 which in turn are supported by respective legs 36, 38, 40, 42 having respective lower pads or feet 44, 46, 48, 50 resting on surface 12. The motor has a downwardly axially extending rotary motor shaft 52 engaging fan hub 54.

Figure 3:
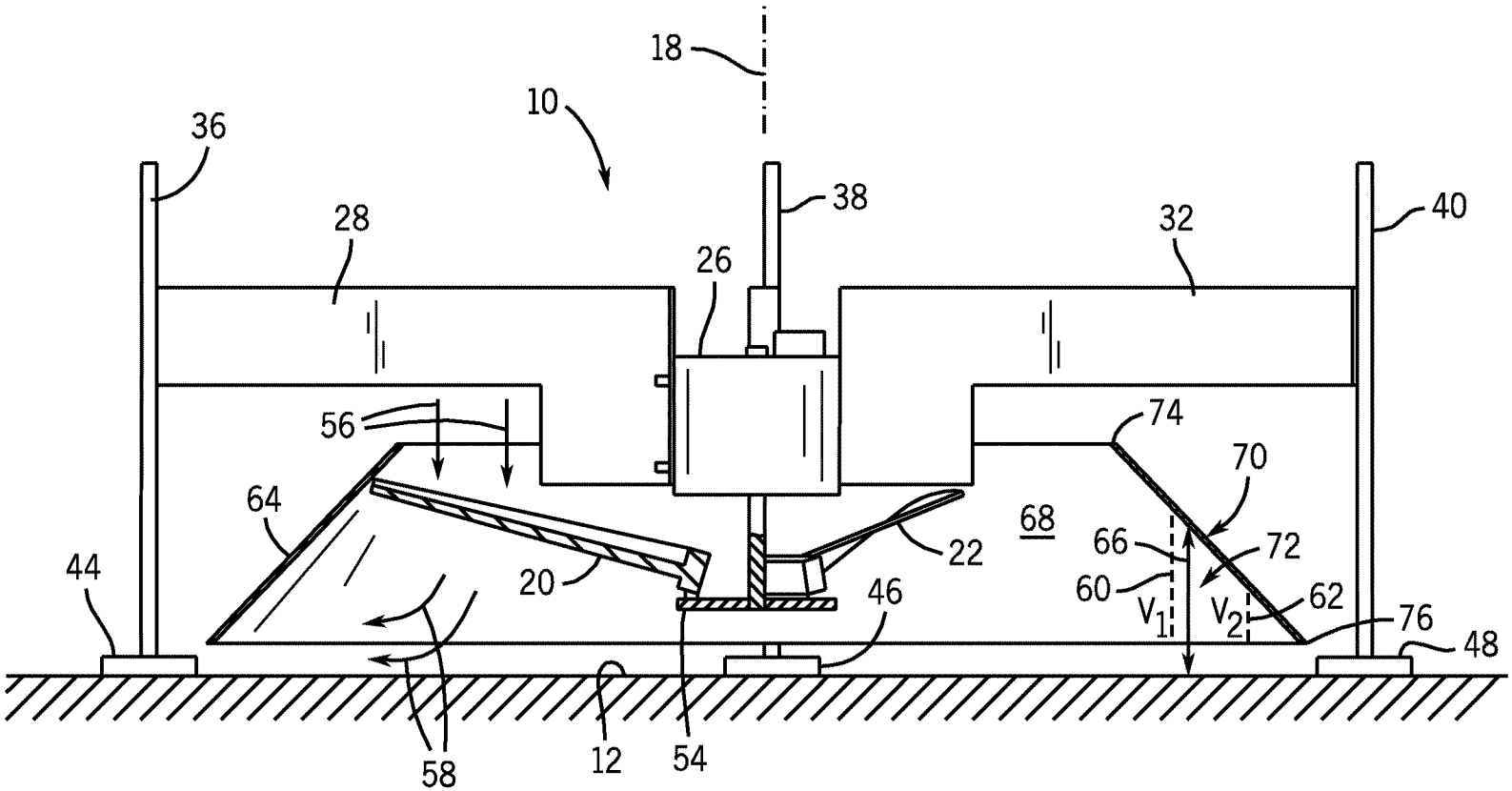
FIG. 3 is a sectional view taken along line 3-3 of FIG. 2.

During operation and rotation of the fan blades, air flows axially downwardly as shown at arrows 56, FIG. 3, and then radially outwardly as shown at arrows 58. The driven air has a velocity $V_0$ immediately adjacent the fan blades, a velocity $V_1$ radially outwardly of the blades at a first circumference 60 therearound, and a velocity $V_2$ further radially outwardly of the blades at a second circumference 62 around the noted first circumference. The housing has a shroud 64 extending radially outwardly of the fan blades and axially spaced from surface 12 by an annular gap 66 therebetween and defining an annulus 68 providing an air flow channel. The shroud has a shape selected to minimize differential velocity between $V_0$ and $V_1$ and $V_2$. In the preferred embodiment, $V_0$ equals $V_1$ equals $V_2$. Shroud 64 has a taper 70 selected to provide a narrowing venturi 72 to maintain substantially constant air flow velocity from first circumference 60 to second circumference 62 notwithstanding the larger fan-out radial dimension of the latter. Surface 12 is typically a flat horizontal surface. Annular gap 66 has an axial height between shroud 64 and surface 12 including a first axial height $H_1$ at first circumference 60, and a second axial height $H_2$ at second circumference 62. First circumference 60 is radially spaced from the axis of rotation 18 by a first radius $R_1$, and second circumference 62 is radially spaced from axis 18 by a second radius $R_2$. In the preferred embodiment $$\frac{R_1}{R_2} = \frac{H_2}{H_1}.$$

This has been found to provide improved fluid dynamics of the air flow through the fan, providing high air flow velocity for rapid water evaporation, and efficient fan operation.

Shroud 64 extends radially outwardly of the fan blades and is tapered relative to axis 18 and relative to the noted radial direction 58. The shroud has an annular shape having an inner circumference 74 of a first radius, and an outer circumference 76 of a second radius greater than the noted radius of inner circumference 74. Inner circumference 74 is an air inlet, and outer circumference 76 is an air outlet. Air flows axially inwardly as shown at arrows 56 towards the fan blades at the inlet, and air flows radially outwardly away from the fan blades at outlet 76. Motor 26 is axially spaced from the fan blades along a first axial direction, e.g. upwardly in FIG. 1. Shroud 64 tapers at 70 radially outwardly and axially in a second axial direction, e.g. downwardly in FIG. 1, from inner circumference 74 to outer circumference 76. The noted second axial direction is opposite to the noted first axial direction. In the preferred embodiment, the shroud as a frusto-conical shape. Further in the preferred embodiment, the taper 70 of the shroud is rectilinear as it extends radially outwardly and axially from inner circumference 74 to outer circumference 76. Alternatively, the taper may have other shapes along such extension, e.g. arcuate, bell-shaped, and so on.

Figure 4:
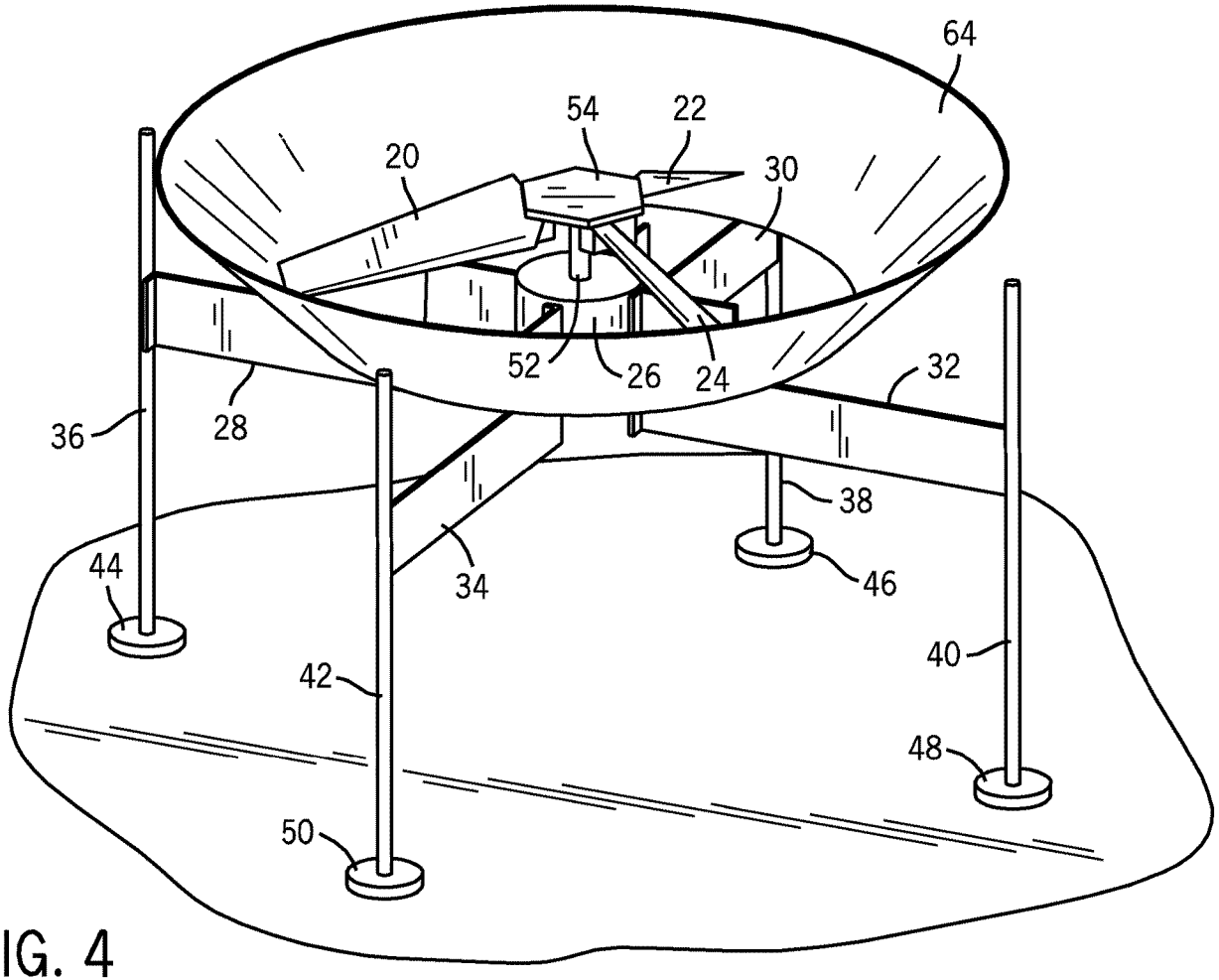
FIG. 4 is a perspective view showing another embodiment.

FIG. 4 shows another embodiment and uses like reference numerals from above where appropriate to facilitate understanding. Feet or pads 44, 46, 48, 50 are provided at the other ends of respective legs 36, 38, 40, 42 to reverse the vertical orientation of the fan to provide a fan for drying a ceiling. In further embodiments, the fan may be adapted for drying a wall, or other surfaces.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations described herein may be used alone or in combination with other configurations. It is expected that various equivalents, alternatives and modifications are possible within the scope of the appended claims.

What is claimed is:

1. A method of making a drying fan for drying a surface, the method comprising:

providing a housing;

providing a motor driven fan supported on said housing for rotation about an axis and having fan blades directing air radially relative to said axis, said air having a velocity $V_0$ immediately adjacent said blades, a velocity $V_1$ radially outwardly of said blades at a first circumference therearound, and a velocity $V_2$ further radially outwardly of said blades at a second circumference around said first circumference;

providing a shroud on the housing so that the shroud extends radially outwardly of said blades and is axially spaced from said surface by an annular gap therebetween defining an annulus providing an air flow channel; and selecting the shape of the shroud so as to minimize differential velocity between $V_0$ and $V_1$ and $V_2$ so that $V_0=V_1=V_2$.

2. A method of making a drying fan for drying a surface, the method comprising:

providing a motor-driven fan supported on a housing for rotation about an axis and having fan blades directing air radially relative to said axis, said air having a velocity $V_0$ immediately adjacent said blades, a velocity $V_1$ radially outwardly of said blades at a first circumference therearound, and a velocity $V_2$ further radially outwardly of said blades at a second circumference around said first circumference, providing a shroud extending radially outwardly of said blades and axially spaced from said surface by an annular gap therebetween defining an annulus providing an air flow channel;

providing said shroud so that said gap has an axial height between said shroud and said surface including a first axial height $H_1$ at said first circumference and a second axial height $H_2$ at said second circumference, said first circumference is radially spaced from said axis of rotation by a first radius $R_1$, said second circumference is radially spaced from said axis of rotation by a second radius $R_2$, and so that $$\frac{R_1}{R_2} = \frac{H_2}{H_1};$$

and selecting the shape of the shroud so as to minimize differential velocity between $V_0$ and $V_1$ and $V_2$.

3. A drying fan for drying a surface, the drying fan comprising:

a housing, a motor driven fan supported on said housing for rotation about an axis and having fan blades directing air radially relative to said axis, said air having a velocity $V_0$ immediately adjacent said blades, a velocity $V_1$ radially outwardly of said blades at a first circumference therearound, and a velocity $V_2$ further radially outwardly of said blades at a second circumference around said first circumference, wherein said housing comprises a shroud extending radially outwardly of said blades and axially spaced from said surface by an annular gap therebetween defining an annulus providing an air flow channel, said gap having an axial height between said shroud and said surface including a first axial height $H_1$ at said first circumference and a second axial height $H_2$ at said second circumference, said first circumference is radially spaced from said axis of rotation by a first radius $R_1$, said second circumference is radially spaced from said axis of rotation by a second radius $R_2$, and wherein $$\frac{R_1}{R_2} = \frac{H_2}{H_1};$$

and wherein the shape of the shroud minimizes differential velocity between $V_0$ and $V_1$ and $V_2$ so that $V_0=V_1=V_2$.

* * * * *